United States Patent [19]

Schampier

[11] 3,977,450

[45] Aug. 31, 1976

[54] SPRING TOP AND LAUNDRY BAG

[75] Inventor: Virginia Schampier, Plainview, N.Y.

[73] Assignee: Lawrence Peska Associates, Inc., New York, N.Y. ; a part interest

[22] Filed: Apr. 11, 1975

[21] Appl. No.: 567,070

[52] U.S. Cl. ..... 150/1; 220/63 R; 248/95

[51] Int. Cl.[2] ..... B65D 27/00

[58] Field of Search ..... 248/95; 220/63 R; 150/1

[56] References Cited

UNITED STATES PATENTS

| | | | |
|---|---|---|---|
| 344,340 | /1886 | Barrow | 150/1 |
| 1,052,379 | 2/1913 | Ranken | 150/1 |
| 1,447,636 | 3/1923 | White | 150/1 |
| 1,588,695 | 6/1926 | Boehm | 150/1 |
| 1,918,793 | 7/1933 | Baker | 150/1 |
| 2,064,594 | 12/1936 | Dickey | 150/1 |
| 2,437,149 | 3/1948 | Baxter | 150/1 |
| 2,913,029 | 11/1959 | Paton | 150/1 |
| 3,130,853 | 4/1964 | Colthurst | 220/63 R |

*Primary Examiner*—Ro E. Hart

[57] ABSTRACT

A laundry bag with a stay open spring top adapted to accommodate fitting the bag into any size hamper.

5 Claims, 5 Drawing Figures

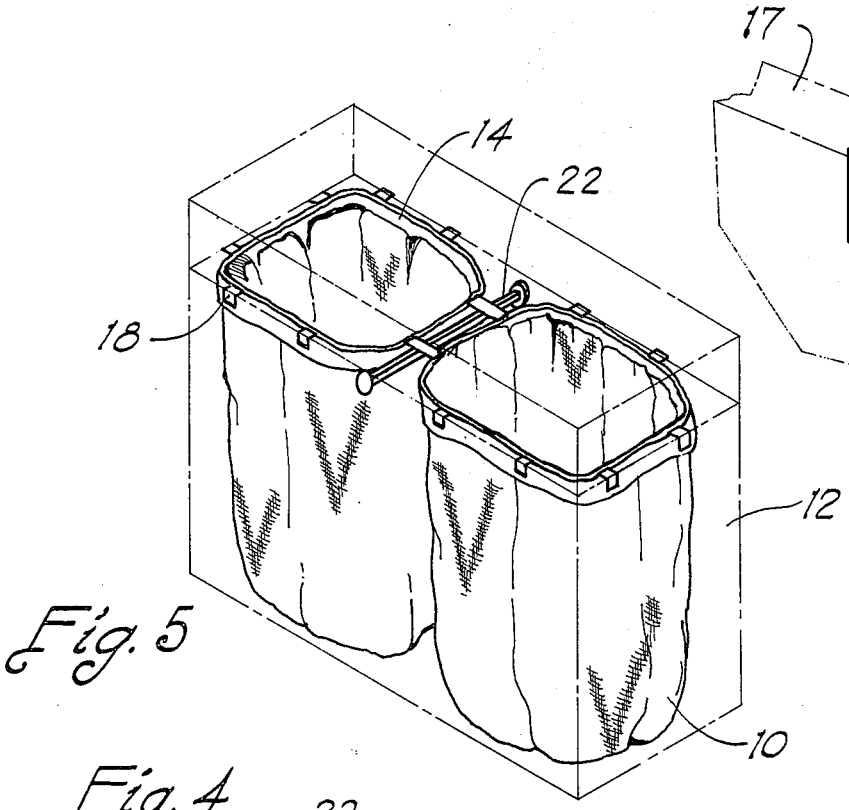
Fig. 5
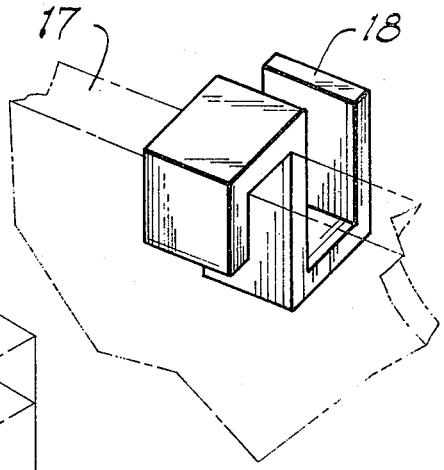
Fig. 3
Fig. 4
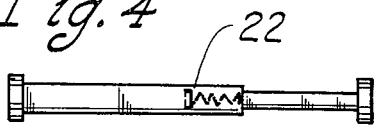
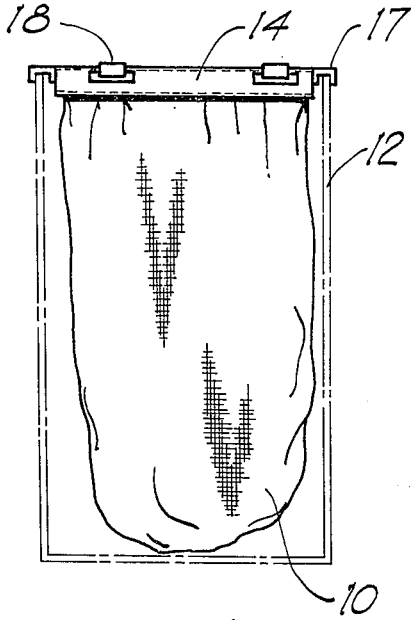
Fig. 1
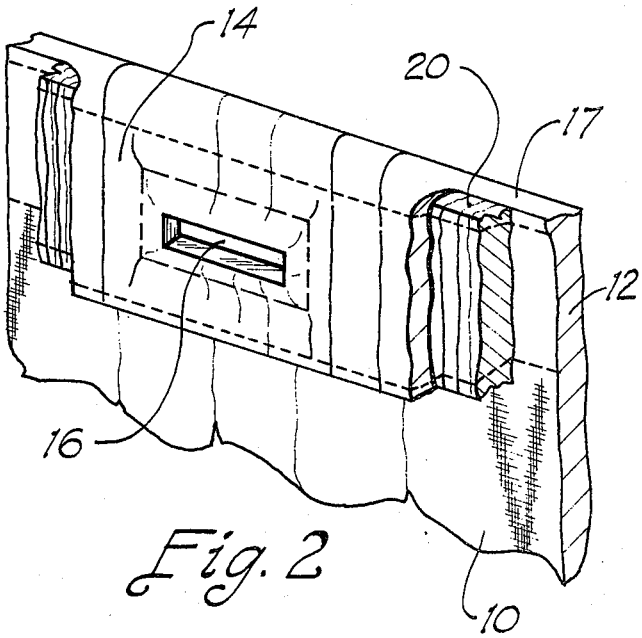
Fig. 2

SPRING TOP AND LAUNDRY BAG

BACKGROUND OF THE INVENTION

This invention relates to a laundry bag having a new and improved spring top especially adapted for easy fitting of the bag into a variety of hampers. More particularly, the invention relates to an improved device that may be employed in tandem, or more, such that time is saved in sorting laundry and substantially prevents the droppage of laundry from the bag when carrying the same. The bag is especially adapted to remain open while the same is in position to be filled with laundry.

The prior art teaches a variety of devices for the holding of laundry. For example, U.S. Pat. No. 2,437,149 relates to a compartmented laundry bag for two loads of clothing and to closure means at the top thereof. U.S. Pat. No. 2,543,299 relates to a combination support and closure flap for laundry bags. It is supportable from the back of a chair. U.S. Pat. No. 2,704,098 relates to a multiple pocket hanging laundry bag. U.S. Pat. No. 2,761,480 relates to a laundry bag hung from a rolling frame. None of the prior art devices, however, teach a laundry bag and support means as are disclosed herein.

SUMMARY OF THE INVENTION

It is accordingly an object of the invention to avoid one or more drawbacks of the prior art.

It is another object of the invention to provide for a simply constructed, easily hung and removed laundry bag.

It is yet another object of the invention to provide for an inexpensive multiple laundry bag arrangement.

These and other objects of the invention will become more apparent from the following detailed disclosure and claims, and in the following drawings in which:

FIG. 1 is a perspective view of a laundry bag apparatus in the hung position;

FIG. 2 is a perspective view of a top portion of the laundry bag shown in FIG. 1;

FIG. 3 is a perspective view of a clip means employed with the bag on the edge of a hamper;

FIG. 4 is an elongated side view of an adjustable rod means used with an embodiment of the invention; and FIG. 5 is a perspective view of an embodiment of the invention showing the laundry bags in tandem arrangement.

DETAILED DESCRIPTION

Broadly speaking, the invention includes the provision of in combination, at least one laundry bag having a top opening and a clip means, the bag having a top rim portion, the rim portion defining a plurality of openings, the rim portion further defining a channel circumferentially traversing the same, elastic means disposed in the channel, and clip means adapted to engage the opening whereby the bag may be vertically supported on a horizontal member.

Referring more particularly to the drawings, there is shown a laundry bag 10 in the hanging position, preferably hung in a hamper 12 or other suitable device. Circumferentially surrounding the upper end of the bag, which is open, there is preferably a rim or hem 14 which is formed by the upper horizontal edge of the open side of the bag 10 folded outwardly or inwardly and then downwardly. In place of the hem 14 there may also be provided some other suitable type of reinforcing means along the horizontal edge. The bag itself is preferably fabric or flexible and defines front and rear wall portions secured together at the lower end by stitching or the like. The wall portions are preferably secured together at their opposite lengthwise edges by stitching or the like.

The hem 14 portion may if desired define a channel running therethrough, though the same is not necessary. The hem portion 14 will, however, define a plurality (at least two) of openings 16 or slots therethrough, between the inner wall of the bag 10 and the exterior thereof. The slots 16 will preferably contain reinforced stitching or the like around their periphery. The slot 16 may be rectangular in shape, though any shape is suitable. The slot 16 is of such dimension that it can engage a clip means 18 to be inserted therethrough. The clip means 18 are substantially Z or S shaped or a combination thereof. The shape of the clip means 18 is such that it is adapted to engage the slot 16 and hold the bag 10 while at the same time being adapted to engage a portion of the rim 17 or like a horizontal edge of vertical support means such as a hamper 12. A portion of the clip means 18 generally fits over the top of the rim 17 while another portion thereof defines a hook like section adapted to receive the recess in the hem portion 14 of the laundry bag 10. In the preferred embodiment the clip means 18 will define two substantially similarly shaped hooking portions, each defining a recess or depression in opposite directions. The clip means 18 may be made of any suitably firm, rigid of resilient material, preferably it is of plastic or metal.

In another embodiment of the invention, the hem portion will define a channel running therethrough adapted to receive an elastic closing means 20 adapted to automatically close the open end of the bag 10 when the same is disengaged from the open hanging position. The elastic means when related close the bag opening, while when under tension, such as when the clip means 18 support the bag 10, the bag 10 is kept open. The slots 16 may go right through the elastic means or the latter may fit below the slot 16.

In a further embodiment the bags 10 may be hung in multiple, such as side by side, i.e., in tandem, shown in FIG. 5. The number of bags 10 that may be hung together is only circumscribed by the size of the hamper. When multiple bags 10 are used, it is preferable to employ an adjustable, such as telescopically adjustable rod means 22 as shown in FIG. 4. The rod means are preferably placed between each bag 10 and will communicate with two opposing rim portions 17 of the hamper 12. The clip means 18 that are adjacent the rod means 22 which are of such width that they will then engage the clip means 18 at that point rather than the rim portion 17 of the hamper 12 as would have been the case in the instance where only a single bag 10 is used.

While the invention has been described with reference to the embodiments shown in the drawings, it is obvious that various changes and modifications may be made in the details of construction without departing from the general spirit of the invention.

What I claimed as new is:

1. In combination, at least one laundry bag having one open end and a plurality of clip means, said bag having a top rim portion peripherally defining said open end, said rim portion defining a plurality of openings, said rim portion further defining an internally disposed channel circumferentially transversing the same, elastic means disposed in said channel, said clip means adapted to both individually engage said opening and a horizontal support member for vertical disposition of said bag therefrom, said elastic means adapted to relax and automatically close the opening of said bag when said clip means are each individually disengaged from said openings or from said support means.

2. The combination as defined in claim 1, wherein said rim portion is formed by an upper horizontal edge of said top opening being folded upon itself downwardly.

3. The combination as defined in claim 1 wherein said clip means define two substantially similarly shaped hooking portions.

4. The combination as defined in claim 1 wherein there are a plurality of bags hung adjacent each other, and an adjustable rod means disposed between adjacent bags and adapted to engage a portion of said clip means.

5. The combination as defined in claim 1 and a hamper means adapted to be receptacle for said laundry bag.

* * * * *